US010555404B2

(12) United States Patent
Zhou

(10) Patent No.: US 10,555,404 B2
(45) Date of Patent: Feb. 4, 2020

(54) SYSTEMS AND METHODS FOR DIMMING LIGHT SOURCES

(71) Applicant: Innovative Building Energy Control, Lake Forest, CA (US)

(72) Inventor: Gangyi Zhou, Lake Forest, CA (US)

(73) Assignee: INNOVATIVE BUILDING ENERGY CONTROL, Lake Forest, CA (US)

( * ) Notice: Subject to any disclaimer, the term of this patent is extended or adjusted under 35 U.S.C. 154(b) by 0 days.

(21) Appl. No.: 16/370,245

(22) Filed: Mar. 29, 2019

(65) Prior Publication Data

US 2019/0313514 A1 Oct. 10, 2019

Related U.S. Application Data

(60) Provisional application No. 62/653,130, filed on Apr. 5, 2018.

(51) Int. Cl.
*H05B 37/02* (2006.01)

(52) U.S. Cl.
CPC ..... *H05B 37/0263* (2013.01)

(58) Field of Classification Search
CPC ..... H05B 37/02; H05B 37/0245; H05B 37/0263; H05B 37/0272; H05B 33/086; H05B 33/0815; H05B 33/0845; H05B 39/02; H05B 39/041; H05B 39/047; G05B 15/00; G05B 2219/2642; G05D 25/02

See application file for complete search history.

(56) References Cited

U.S. PATENT DOCUMENTS 4,418,333 A 11/1983 Schwarzbach et al.
6,275,163 B1 * 8/2001 Bogorad ..... H05B 37/0227 315/155
6,331,813 B1 12/2001 Belliveau
6,720,745 B2 * 4/2004 Lys ..... A61N 5/0616 315/294
7,956,694 B1 6/2011 Wilson
8,102,167 B2 * 1/2012 Irissou ..... H05B 39/08 315/194
8,334,901 B1 * 12/2012 Ganick ..... G01S 1/70 348/131
8,457,502 B2 * 6/2013 Ryan ..... G01S 1/70 398/172
8,471,687 B2 6/2013 Steiner et al.
8,674,616 B2 3/2014 Holman et al.
8,710,754 B2 * 4/2014 Baddela ..... H05B 33/086 315/192
9,074,736 B2 * 7/2015 Recker ..... F21S 9/037
9,112,550 B1 * 8/2015 Ulrich ..... H04B 3/04
9,860,949 B2 * 1/2018 Tyson ..... H05B 37/0272
9,927,821 B2 * 3/2018 Zhou ..... G05D 25/02

(Continued)

*Primary Examiner* — Haissa Philogene
(74) *Attorney, Agent, or Firm* — Umberg Zipser LLP

(57) ABSTRACT

Systems and methods for managing one or more light sources or other devices are disclosed that utilize a dimmer and demodulator. The systems and methods can be used to modulate light from light sources having four-wire drivers. Each dimmer and demodulator follow a protocol of a lighting control system, and permit use of the lighting control system with lighting fixtures having 0-10 VDC dimming drivers. The dimmer and demodulator preferably communicate via a power line carrier method, which delivers the A/C electrical power and the lighting demand simultaneously.

14 Claims, 4 Drawing Sheets

(56) References Cited

U.S. PATENT DOCUMENTS

| | | | |
|---|---|---|---|
| 2004/0066283 | A1 | 4/2004 | Manis et al. |
| 2015/0264755 | A1 | 9/2015 | Hsia et al. |
| 2018/0092313 | A1 | 4/2018 | Avrahamy |

* cited by examiner

SYSTEMS AND METHODS FOR DIMMING LIGHT SOURCES

This application claims priority to U.S. provisional application filed on Apr. 5, 2018 and having Ser. No. 62/653,130. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is lighting control technology.

BACKGROUND

The following description includes information that may be useful in understanding the present invention. It is not an admission that any of the information provided herein is prior art or relevant to the presently claimed invention, or that any publication specifically or implicitly referenced is prior art.

Various systems are known in the art for dimming lights using a mechanical lever. For example, U.S. Pat. No. 9,927,821 discusses a system that uses a mechanical lever to dim a light having a dimmer switch that receives a Pulse-width modulation (PWM) signal from a controller and then adjusts on/off time of each cycle of A/C power to the light to modulate the power and dim the light.

However, not all lights are compatible with such dimming methods. For example, many LED lights are often integrated with drivers having four wires instead of two. In these four wire lights, two of the wires are used to receive power from the grid and the other two wires are used to receive a signal. In other words, these lights can vary the intensity of the light per the voltage on the wires that receive the signal, and cannot work with the traditional systems described above.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for systems for dimming light sources having 4-wire drivers.

SUMMARY OF THE INVENTION

The inventive subject matter provides apparatus, systems and methods for dimming a light source. Contemplated systems and methods are configured to receive a PWM signal, modulate the demand light intensity to the power lines, deliver the modulated power to a demodulator, demodulate the low voltage demand signal from the power lines, and develop interfaces for light sources having four-wire drivers (i.e., two wires for power and two wires for 10 VDC control lines) to deliver the modulated power to the light source. It is contemplated that such systems and methods could be configured to work with such dimming systems as described in U.S. Pat. No. 9,927,821, and with other lighting fixtures having 10 VDC dimming controls.

Contemplated systems and methods may comprise a dimming module having a controller and a transmitter.

Preferably, the dimming module is configured to receive a signal from a first source, and transmit a modulated power signal over a power line to a demodulator that is communicatively coupled to a driver of a light source.

The demodulator is preferably coupled with the light source driver via a set of four wires, where two of the wires comprise an electrical connection between the demodulator and the driver, and the other two wires are used to transmit a dimming signal from the demodulator to the driver. The demodulator is configured to receive the modulated power from the dimming module, and generate the dimming signal.

Preferred light sources are LEDs having a four wire driver, as described above.

Various objects, features, aspects and advantages of the inventive subject matter will become more apparent from the following detailed description of preferred embodiments, along with the accompanying drawing figures in which like numerals represent like components.

DETAILED DESCRIPTION

Throughout the following discussion, numerous references will be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
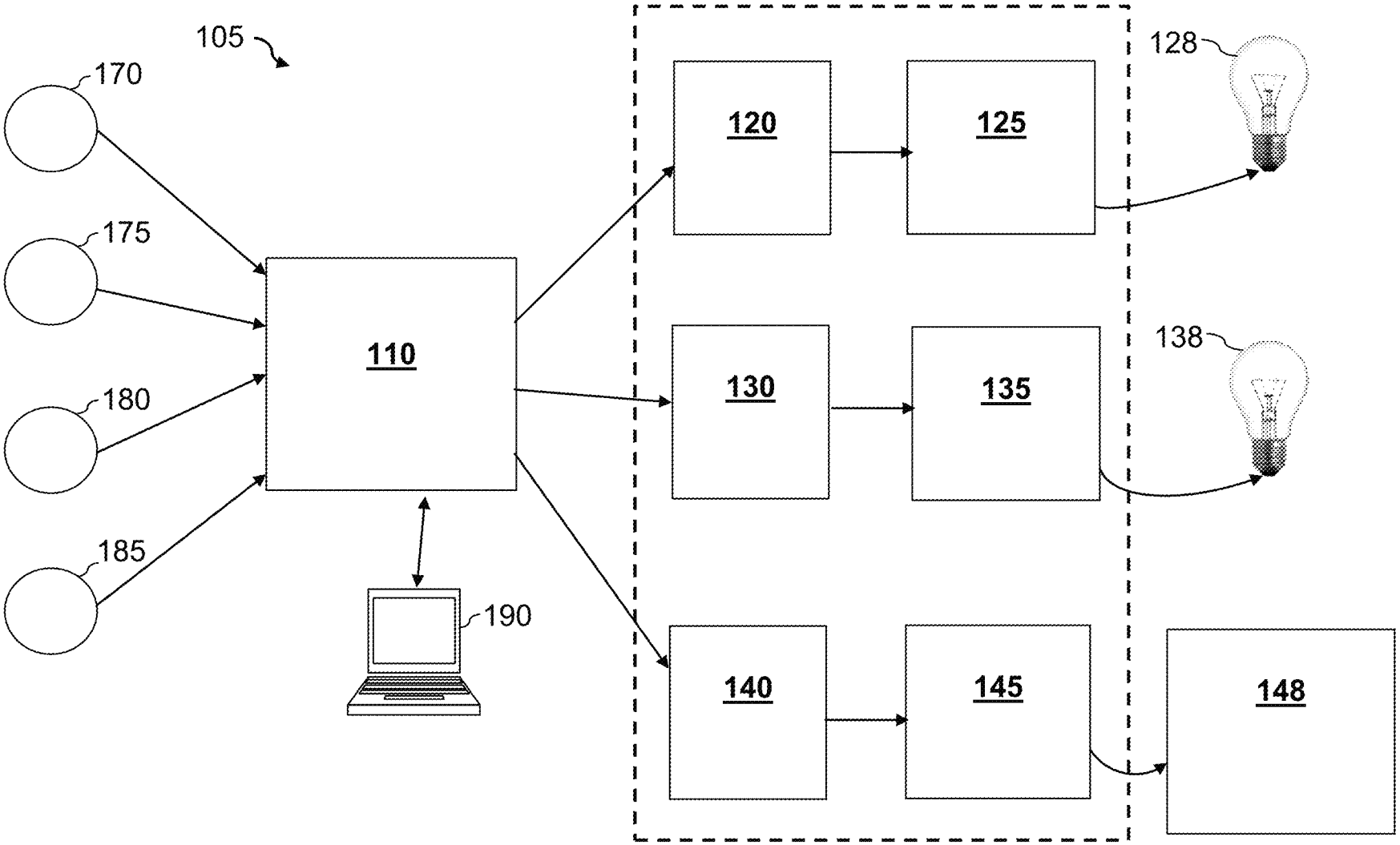
FIG. 1 presents a diagram of one embodiment of a system having a controller module that communicates with a plurality of dimmer switches.

FIG. 1 illustrates one embodiment of a system 105 configured to automatically control a setting of one or more appliances 128, 138, 148 using a controller 110. The controller 110 can obtain a level of ambient light via a sensor output from a photosensor (e.g., 170). The controller 110 can receive signals from other photosensors or other sensors 175, 180, 185. Using an algorithm in the controller 110, the controller 110 decides what illumination level to set the lights (e.g., 128 or 138) on each dimming module (e.g., 120 or 130). Then, the controller 110 sends a demand signal to each of the dimming modules (120 or 130) via a wired connection such as Ethernet (CAT5) cables. Of course other wired connections and wireless connections are also contemplated. The dimming modules 120, 130 can then send a signal to demodulators 125, 135 to control light sources 128, 138, respectively.

Similarly, controller 110 can send a signal to module 140 that communicates with a demodulator 145, which is used to control appliance 148.

In some embodiments, controller 110 can communicate with a remote computing device 190 to receive signals or update a stored program, for example.

Figure 2:
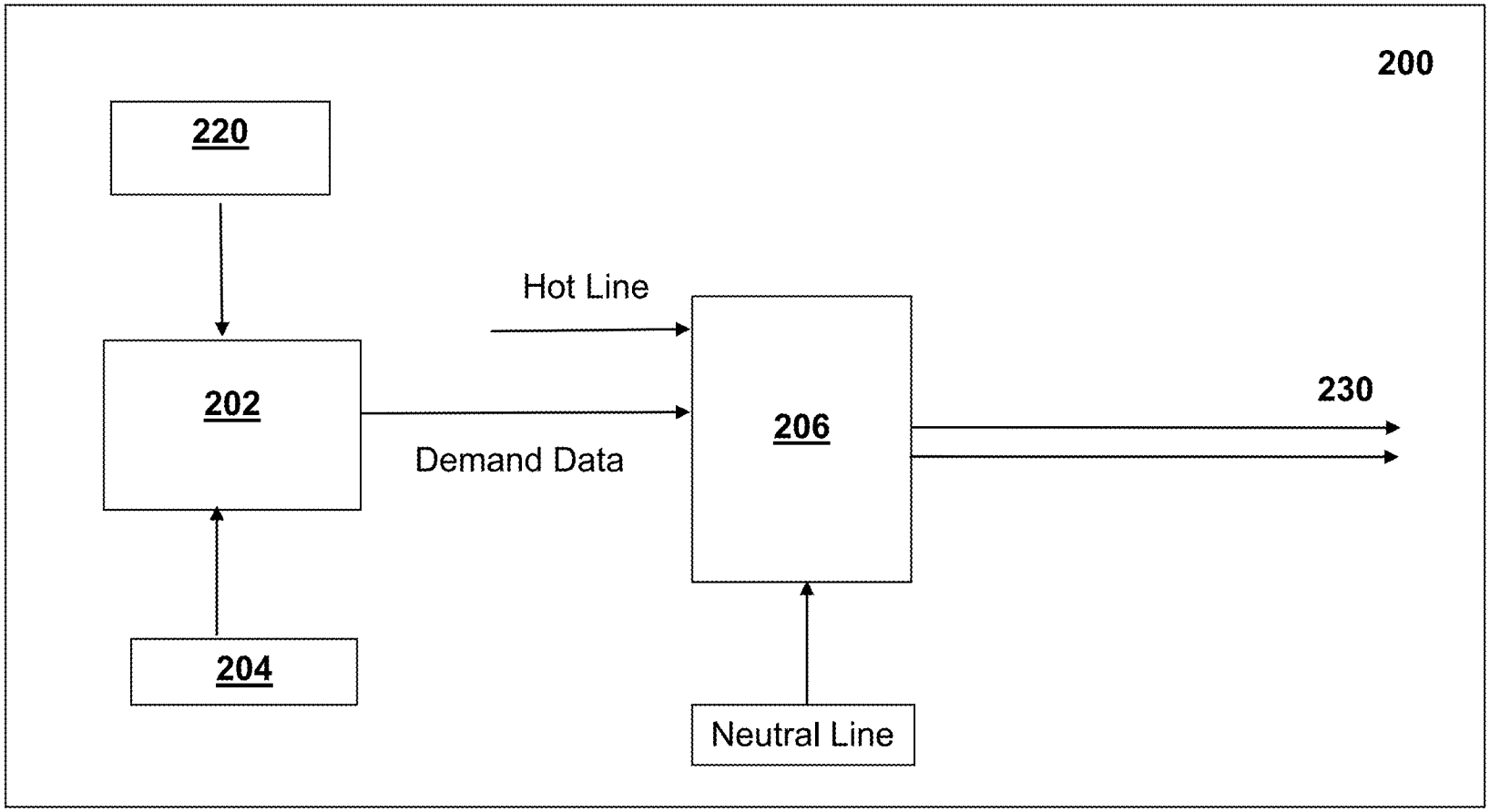
FIG. 2 illustrates a schematic of one embodiment of a dimmer module.

FIG. 2 illustrates the schematic of the dimming module 200. The dimming module 200 has three main components: a microcontroller (MCU) 202, a potentiometer 204, and a power line carrier modem 206 (transmitter). The potentiometer 204 is utilized to dim a light source manually, and send a signal to the MCU 202. The MCU 202 can also receive data from an upstream controller 220 and read the level on the potentiometer 204. It is preferred that the controller 220 can be coupled with the dimming module 200 via a wired connection, such as using CAT5 cable. The MCU 202 preferably receives a signal from one or both of the controller 220 and potentiometer 204, and send demand data to the power line carrier modem 206. The modem 206 then transmits a modulated power signal comprising A/C electrical power and demand data to a demodulator (such as shown in FIG. 3) via power lines 230.

The dimming module 200 can therefore be configured to receive a demand signal (i.e., data) such as from potentiometer 204 or upstream controller 220, and modulate the demand signal to the power lines 230 (hot wire). The power lines 230 carry data as well as A/C electric power transmission to a light or other appliance. This technique is known in the industry as power-line carrier, power-line digital subscriber line (PDSL), mains communication, and power-line telecommunications or power line networking (PLN).

Figure 3:
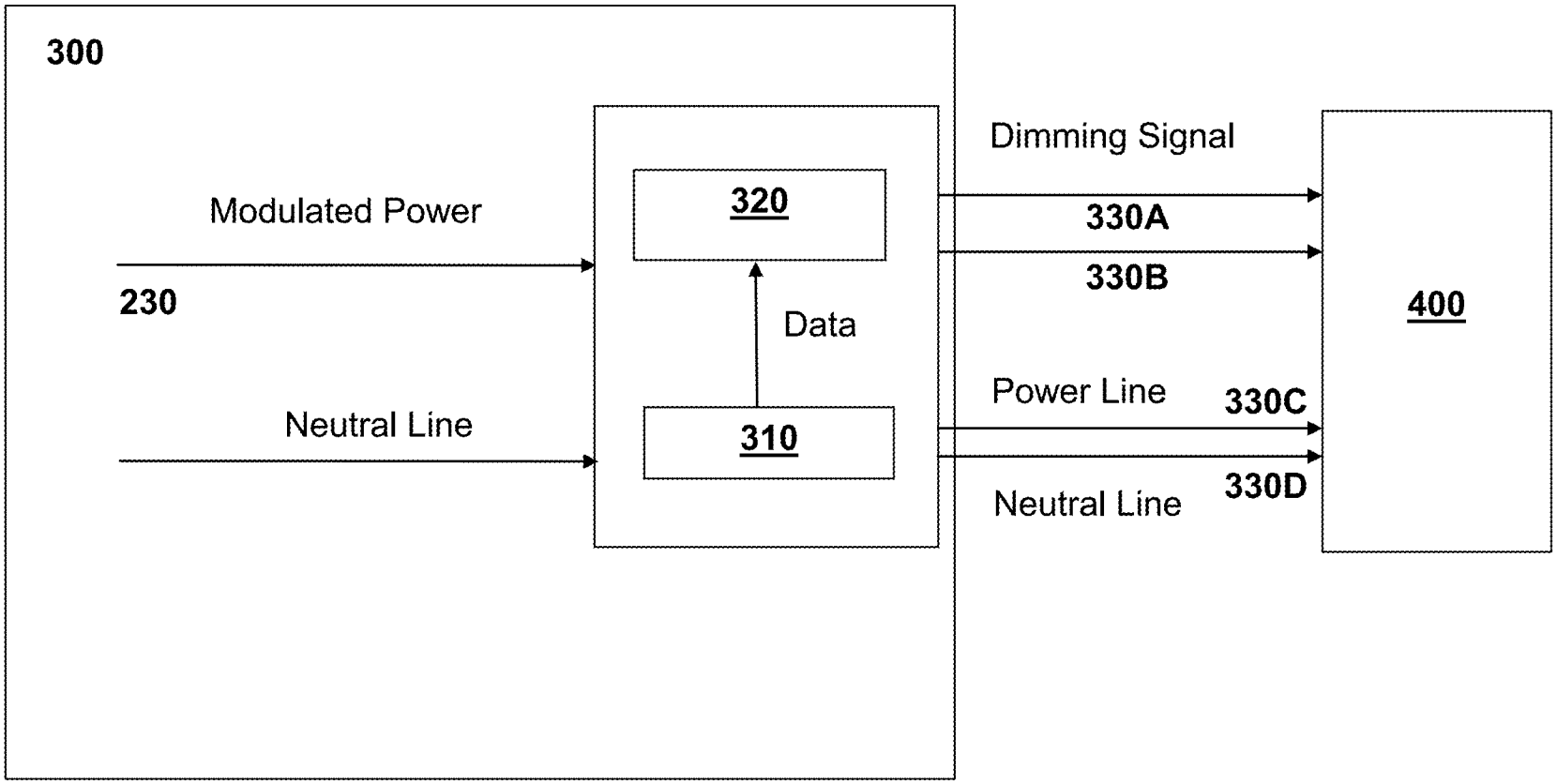
FIG. 3 illustrates a schematic of one embodiment of a demodulator.

FIG. 3 illustrates the schematic of one embodiment of a demodulator 300, which is communicatively coupled to a driver of a light source or other appliance via a set of four wires. The demodulator 300 receives modulated power over power lines 230 from an upstream dimming module 200, such as shown in FIG. 2. A separator 310 separates the modulated power signal into data and power. Then, the data can be converted into a 0-10 VDC dimming signal using converter 320, and a signal can be sent to a light source driver 400, which dims the light source. The four wires 330A-330D (shown as arrows between the demodulator and the driver) then are connected to the driver 400 of the light source. Two of the wires comprise an electrical connection between the demodulator 300 and driver, and the other two wires permit transmission of a dimming signal from the demodulator 300 to the driver.

Thus, at a light source, demodulator 300 can separate the demand signal and A/C electric power, convert the demand signal to a 0-10 VDC signal, and transmit the A/C electric power and demand signal to the driver 400.

Figure 4:
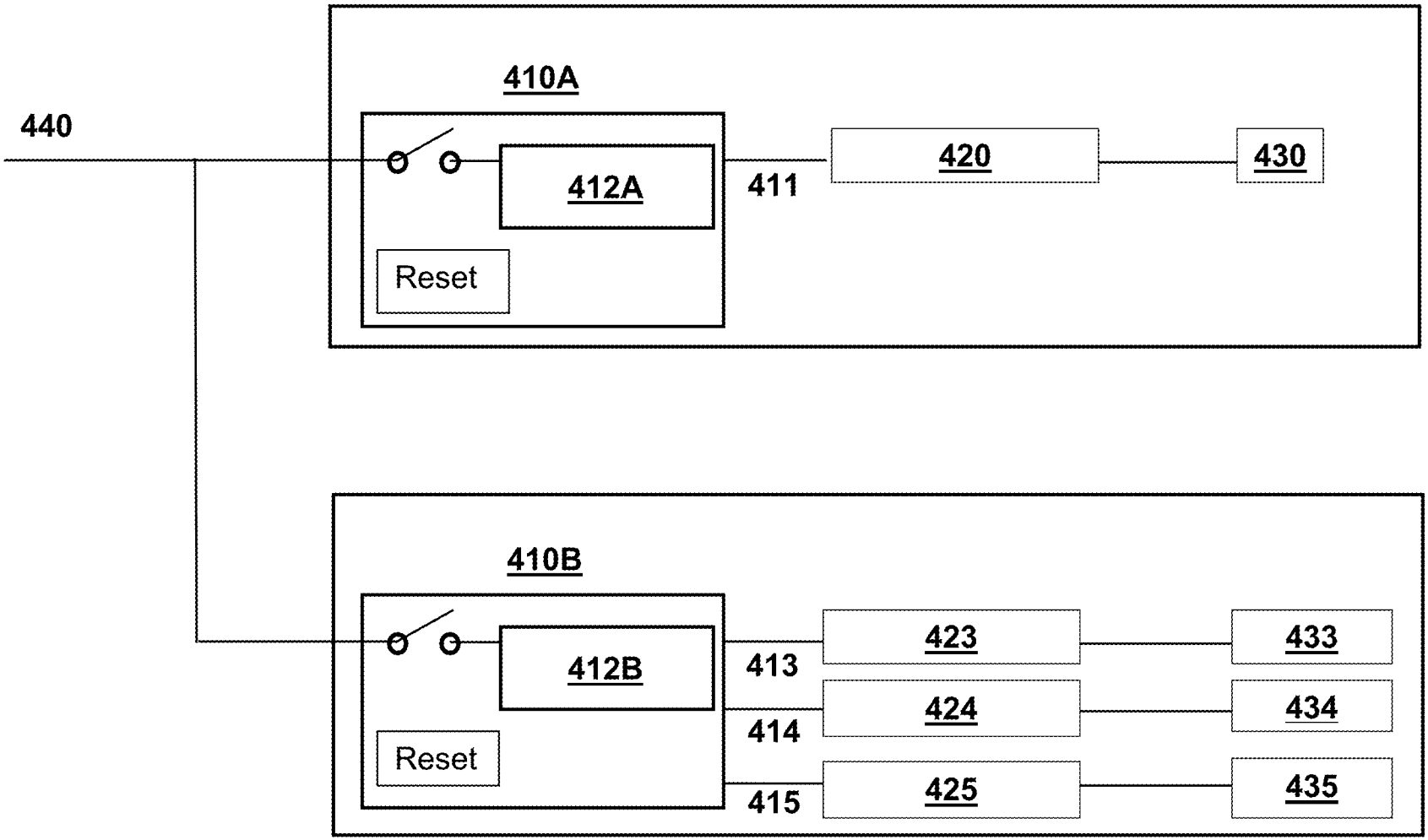
FIG. 4 illustrates a schematic of one embodiment of a method for configuring dimming modules.

FIG. 4 illustrates one embodiment of a system 400 having multiple dimming modules 410A and 410B for dimming various light sources.

Dimming module 410A can comprise a modulator 412A configured to generate a modulated signal for transmission over power line 411 to demodulator 420. Thus, power line 411 can carry data as well as A/C electric power transmission to demodulator 420. In some embodiments, the dimming modules 410A, 410B can each comprise a controller and transmitter, and be configured to receive a signal from a central controller 440 and transmit a modulated power signal over a power line (e.g., 411, 413, 414, 415).

The demodulator 420 receives the modulated power over power line 411, and separates the modulated power signal into data and power. The demodulator 420 then converts the data into a 0-10 VDC signal, and a signal is sent to light source driver 430, which dims a connected light source. It is especially preferred that the demodulator 420 and driver 430 are coupled to one another via four wires, two for power and two for data.

Similarly, dimming module 410B can comprise a modulator 412B configured to generate one or more modulated signals for transmission over power lines 413-415 to demodulators 423-425, respectively. Thus, power lines 413-415 can carry data as well as A/C electric power transmission to demodulators 423-425.

Each of the demodulators 423-425 is preferably coupled to a driver (e.g., 433-435) of a light source or other appliance via four wires, where two of the wires provide an electrical connection between a demodulator and driver, and the other two wires permit transmission of a dimming signal from a demodulator. Each of the demodulators 423-425 receives the modulated power over their respective power line, and separates the modulated power signal into data and power. Each of the demodulators 423-425 then converts the data into a 0-10 VDC signal, and a signal is sent to the connected light source driver (e.g., demodulator 423 sends a signal to driver 433, demodulator 424 sends a signal to driver 434, and demodulator 425 sends a signal to driver 435), which dims their connected light source. It is especially preferred that the demodulators 423-425 are each connected to a driver 433-435, respectively, via four wires, two for power and two for data.

In some embodiments, the demodulators discussed above can comprise a memory, which preferably is a portable memory card (e.g., secure digital (SD) memory card or subscriber identification module (SIM) card). The memory of the demodulator can be used to store a signature of a dimming module, such that the demodulator can determine whether an incoming signal is meant for the demodulator. This is because using power line carrier means signals are broadcasted to the network (here, the power line), which means that all of the devices on the power line can "hear" the communication data to all devices. To ensure a demodulator only acts upon signals meant for it, the signature of a received signal can be reviewed to determine if it came from an authorized dimming module. If not, the signal can be disregarded. Without such review, a dimming module may control lights in other rooms or even other buildings.

In some embodiments, the demodulators require programming to ensure they can recognize and respond to only the data directed to them. In such embodiments, it is contemplated that an automatic pairing procedure (APP) could be used to program the demodulators, rather than require an electrician to use software to configure each of the dimming modules and the demodulators in a system.

Using the APP, it is contemplated that the dimming module and demodulator can have identical digital signatures (e.g., IP address, encrypted identification code, etc.). The demodulator may also have a portable memory card, such as described above.

All of the demodulators and dimming modules can be connected to the power line.

A main switch can be turned off at each dimming module, at which point the dimming module and connected demodulator are isolated from the power line (e.g., they are now on an isolated network).

A "reset" button, such as shown in FIG. 4, can be actuated on a dimming module, which causes the dimming module to broadcast its digital signature over the isolated network. The demodulator can be configured to "hear" the digital signature and record it on its memory such that the demodulator will know what data packages are for it.

Once this is completed for each of the dimming module/demodulator pairs, the APP procedure ends.

If the demodulator comprises a portable memory card, such as described above, a user would only need to remove the portable memory card from a broken demodulator and insert the memory card into the replacement demodulator. This advantageously eliminates the need to pair the new demodulator with the dimming module, such as by using the APP procedure described above, greatly simplifying installation.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A system for dimming a light source, comprising:

a dimming module having a controller and a transmitter, wherein the dimming module is configured to receive a signal from a first source and transmit modulated power over a power line;

a demodulator communicatively coupled to a driver of a light source via a set of four wires, wherein two of the wires of the set comprises an electrical connection between the demodulator and the driver, and the other two wires of the set permit transmission of a dimming signal from the demodulator; and wherein the demodulator is configured to receive the modulated power from the dimming module, and generate the dimming signal.

2. The system of claim 1, wherein the signal from the first source is received from an upstream controller remote from the dimming module.

3. The system of claim 1, wherein the signal from the first source is received from a manual switch at the dimming module.

4. The system of claim 1, wherein the demodulator is communicatively coupled with the dimming module over the power line.

5. The system of claim 1, wherein the demodulator further comprises a separator configured to separate data from the modulated power, wherein the data is converted into the dimming signal.

6. The system of claim 5, wherein the dimming signal comprises a 0-10 VDC signal.

7. The system of claim 1, wherein the dimming module is configured to receive the signal via a wired connection from a central controller.

8. A system for dimming a plurality of light sources, comprising:

a first dimming module having a controller and a transmitter, wherein the first dimming module is configured to receive a first signal from a central controller and transmit a first modulated power signal over a power line;

a second dimming module having a controller and a transmitter, wherein the second dimming module is configured to receive a second signal from the central controller and transmit a second modulated power signal over the power line;

a first demodulator communicatively coupled to a first driver of a first light source via a first set of four wires, wherein two of the wires of the first set comprises an electrical connection between the first demodulator and the first driver, and the other two wires of the first set permit transmission of a first dimming signal from the first demodulator;

a second demodulator communicatively coupled to a second driver of a second light source via a second set of four wires, wherein two of the wires of the second set comprises an electrical connection between the second demodulator and the second driver, and the other two wires of the second set permit transmission of a second dimming signal from the second demodulator; and wherein the first demodulator is configured to receive the first modulated power signal from the first dimming module, and generate the first dimming signal, and wherein the second demodulator is configured to receive the second modulated power signal from the second dimming module, and generate the second dimming signal.

9. The system of claim 8, wherein the first dimming module and first demodulator comprise an identical digital signature.

10. The system of claim 8, wherein the central controller is distinct from the first and second dimming modules.

11. The system of claim 8, wherein the first demodulator is communicatively coupled with the first dimming module over the power line.

12. The system of claim 8, wherein the first demodulator further comprises a separator configured to separate data from the first modulated power signal, wherein the data is converted into the first dimming signal.

13. The system of claim 12, wherein the dimming signal comprises a 0-10 VDC signal.

14. The system of claim 8, wherein the first dimming module is configured to receive the first modulated power signal via a wired connection from the central controller.

* * * * *